United States Patent [19]

Belisle

[11] 3,966,251

[45] June 29, 1976

[54] ROCKER SPRING UNIT

[75] Inventor: Adelard J. Belisle, South Hadley Falls, Mass.

[73] Assignee: Dual Manufacturing and Engineering Incorporated, Holyoke, Mass.

[22] Filed: July 15, 1974

[21] Appl. No.: 488,305

Related U.S. Application Data

[63] Continuation of Ser. No. 270,054, July 10, 1972, abandoned.

[52] U.S. Cl. ..... 297/267; 297/261

[51] Int. Cl.[2] ..... A47C 3/02

[58] Field of Search ..... 297/261, 264–267

[56] References Cited

UNITED STATES PATENTS

| | | | |
|---|---|---|---|
| 401,684 | 4/1889 | Bunker | 297/266 |
| 403,325 | 5/1889 | Bunker | 297/266 |
| 461,648 | 10/1891 | Stevens | 297/266 |
| 575,804 | 1/1897 | Evans | 297/266 |
| 2,813,574 | 11/1957 | Hawkins | 297/267 |
| 2,871,916 | 2/1959 | Fox | 297/267 |
| 3,167,350 | 1/1965 | Kiel | 297/267 |
| 3,190,693 | 6/1965 | Underdown | 297/266 |
| 3,371,958 | 3/1968 | Caldemeyer | 297/267 |
| 3,462,190 | 8/1969 | Campbell | 297/265 |

FOREIGN PATENTS OR APPLICATIONS

| | | | |
|---|---|---|---|
| 142,561 | 1/1950 | Australia | 248/388 |

*Primary Examiner*—Roy D. Frazier
*Assistant Examiner*—William E. Lyddane
*Attorney, Agent, or Firm*—Ross, Ross & Flavin

[57] ABSTRACT

Spring means integrated as a unit for ready association with the rocker and base elements of a chair by the attachment of the unit in situ for operational use, securement to the base and/or rocker elements being obtained without the use of screws or bolts by stops on the spring retainers comprising axially-aligned horizontally-disposed extensions which extend outwardly beyond the walls of an opening in the rocker base or rocking component through which the rocker spring unit passes thereby precluding unwanted displacement of the unit away from the rocker and base elements as the chair is rocked.

5 Claims, 18 Drawing Figures

ROCKER SPRING UNIT

This is a continuation of my copending application Ser. No. 270,054 filed July 10, 1972 now abandoned.

The invention relates to spring means for articulating platform rocker chairs and like chairs employing rocker spring devices and more particularly to a spring unit serving to rockably associate the rockable component with the base component of a chair, the elements of the spring means being integrated and being unitarily associated with the chair components by mere attachment thereto.

The main object of the invention is to provide a rocker spring unit which is strong and may be easily secured to the base and rocking members of a platform rocking chair, securement to the base member and/or rocking member being had by novel stop means and without the use of bolts or screws or like fastening means.

By such construction, it is possible to lower the chair seat and to do away completely with such as mounting screws or bolts.

These and other features of the invention are described at length below in connection with the drawings, attached hereto, wherein.

Figure 1:
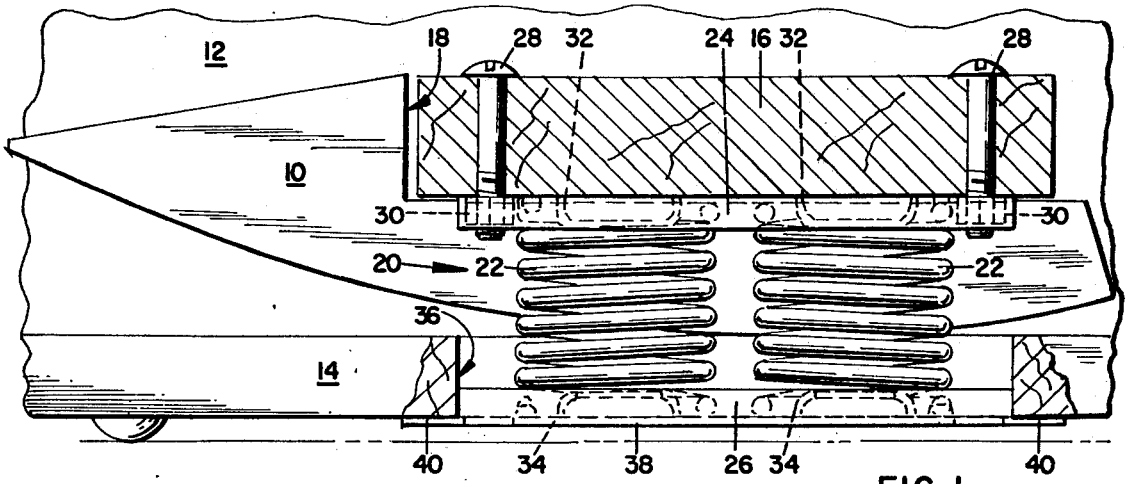
FIG. 1 is a fragmentary view, in side elevation, partly in section, of a preferred embodiment of the spring unit in association with the components of a platform rocker chair.
Figure 2:
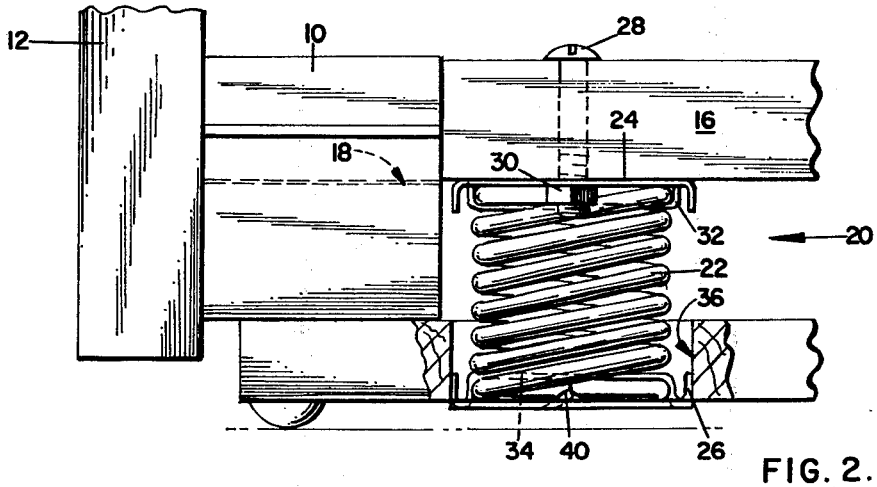
FIG. 2 is a fragmentary view, in end elevation, partly in section, of the structure shown in FIG. 1.
Figure 3:
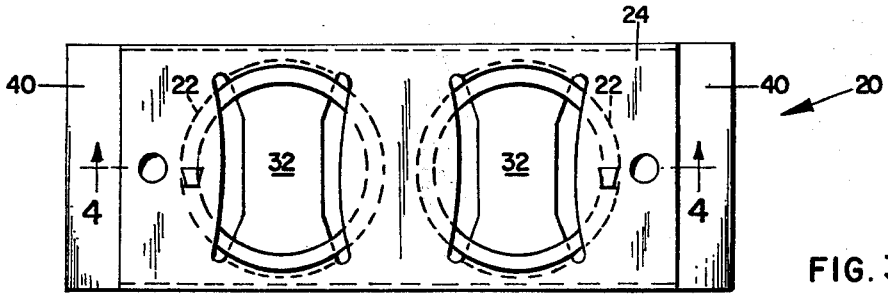
FIG. 3 is a view, in top plan, of the FIG. 1 spring unit.
Figure 4:
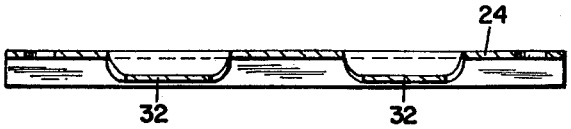
FIG. 4 is a view, in section, on line 4—4 through the top spring retainer of the spring unit of FIG. 3.

With reference first to FIGS. 1 – 4, a platform rocker is provided with conventional rocker blocks 10 at each side of the chair and fixed to the chair arms 12 so as to be rockably supported upon a rocker base 14.

An arm stretcher 16, which extends between and interconnects the chair arms 12, is seated in a cut-out 18 provided in the upper surface of each rocker block.

Rocker spring units embodying a preferred form of the invention extend between arm stretcher 16 and rocker base 14.

Only one rocker spring unit, generally indicated by 20, has been shown in the drawings, although it will be understood that two rocker spring units will be employed, one at each side of the chair.

Rocker spring units 20 include a pair of coil springs 22 which extend between and are fixed to upper and lower spring retainers 24 and 26 respectively.

Upper spring retainer 24 is attached to the lower surface of arm stretcher 16 by means of bolts 28 which extend downwardly through aligned openings in the arm stretcher and the upper spring retainer and have nuts 30 threaded thereon.

The uppermost convolutions of the springs are retained in downwardly struck portions 32 on upper spring retainer 24 and the lowermost convolutions are retained in upwardly struck portions 34 on lower spring retainer 26.

The rocker spring units extend upwardly through provided openings 36 in rocker base 14.

A lower wall 38 of lower spring retainer 26 is provided with vertical stops in the form of axially-aligned horizontally-disposed extensions 40 on its longitudinal axis at each end thereof which extend outwardly therefrom so as to underlie the lower face of rocker base 14.

The length and width of opening 36 is such as to permit the free passage of the entire rocker spring unit therethrough with the exception of lower wall 38 of lower spring retainer 26 which is of greater length than that of opening 36, with the stops 40 extending past the end walls of said opening so as to bridge the opening.

By this novel arrangement, the rocker spring unit is secured relative to rocker base 14 without the use of bolts or screws or other fastening means, the stops 40 effectively precluding any unwanted displacement of lower spring retainer 26 as the chair is rocked.

Figure 5:
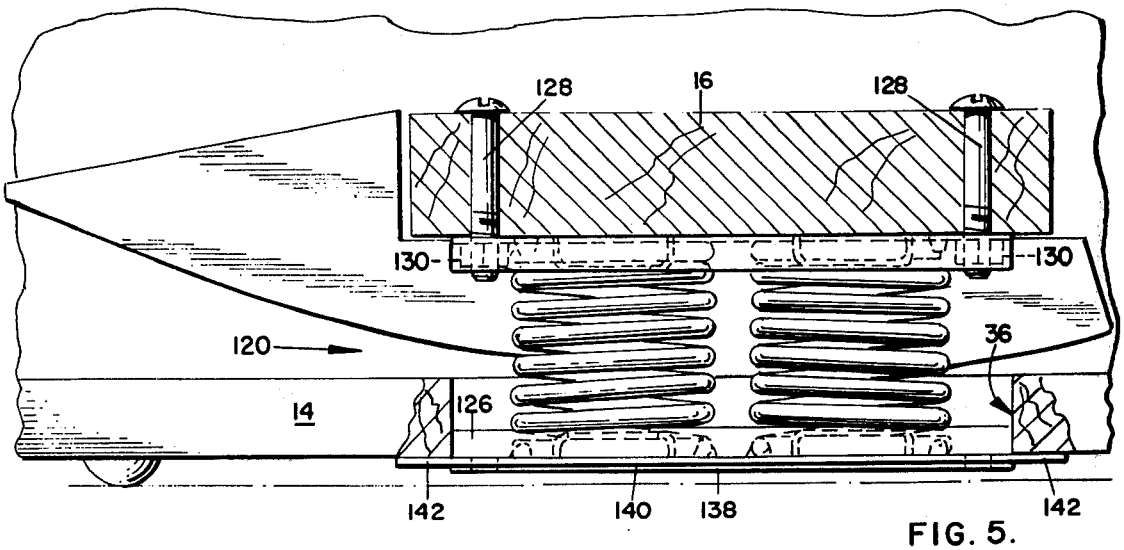
FIG. 5 is a fragmentary view, similar to FIG. 1, of a second embodiment of the spring unit of the invention.
Figure 6:
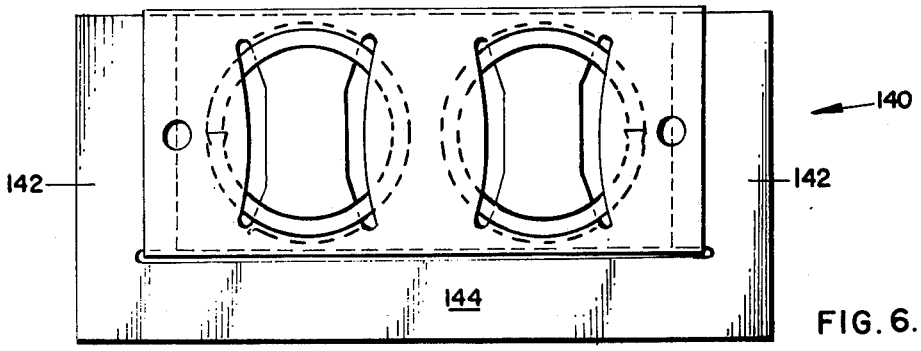
FIG. 6 is a view, in top plan, of the FIG. 5 spring unit.
Figure 7:
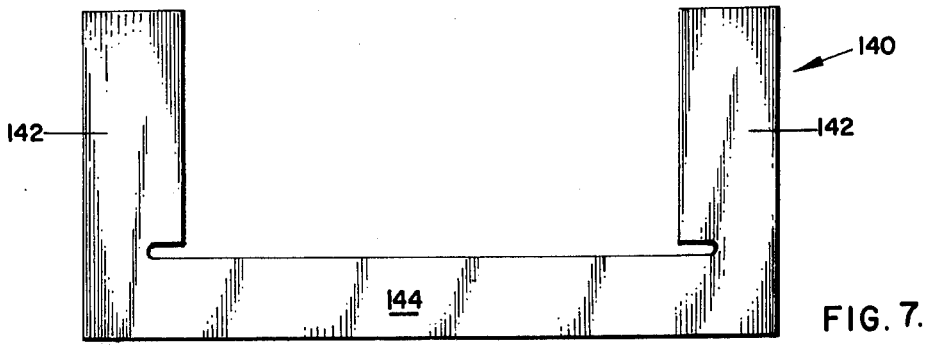
FIG. 7 is a view, in top plan, of the stop plate of the spring unit of FIGS. 5 and 6.

The embodiment of FIGS. 5 – 7 is virtually identical to that of the preferred FIGS. 1 – 4 embodiment with the exception that the lower wall of the lower spring retainer of the rocker spring unit is not formed with integral stops or extensions.

In this embodiment, a rocker spring unit 120 has a lower spring retainer 126, the lower wall 138 of which is of approximately the same dimensions as those of opening 36 in rocker base 14.

A U-shaped stop plate 140 comprising a pair of arms 142 interconnected at one end by a web portion 144 is slidably associated with lower spring retainer 126, with the arms extending outwardly from the ends of spring retainer 126 and the web portion extending outwardly from one side edge thereof so as to extend beyond the ends and one side wall of opening 36 in rocker base 14 to bridge the opening and to bear on the lower face of the rocker base.

Herein the rocker spring unit is inserted through opening 36 in the rocker base and stop plate 140 is attached to secure the unit to the rocker base, again without the use of screws or bolts or other fastening means and then the unit is attached to arm stretcher 16 as by bolts 128 and nuts 130.

Figure 8:
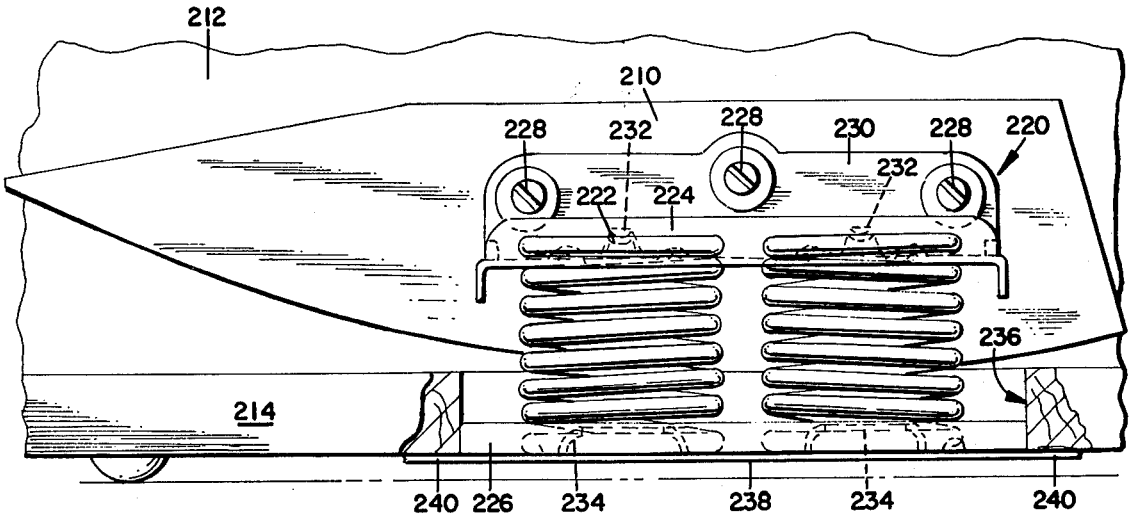
FIG. 8 is a fragmentary view, in side elevation, partly in section, of a third embodiment of the spring unit of the invention in association with the components of a platform rocking chair.
Figure 9:
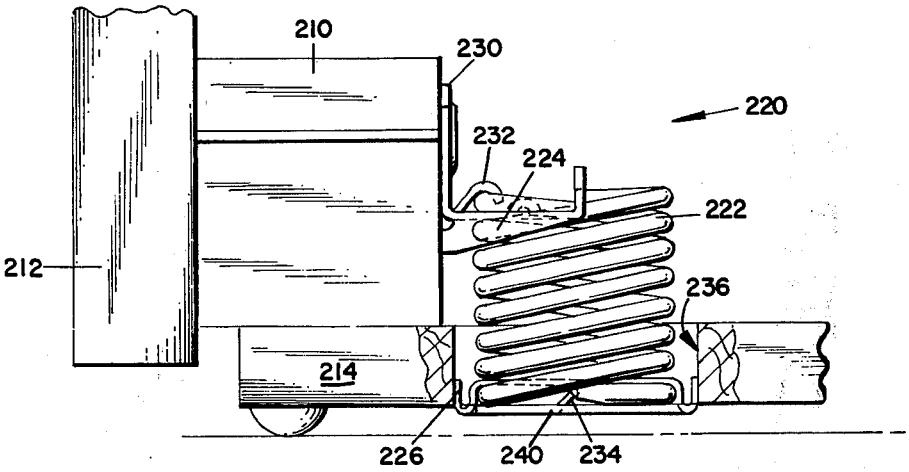
FIG. 9 is a fragmentary view, in end elevation, partly in section, of the structure shown in FIG. 9.

The top portion of the embodiment of FIGS. 8 and 9 is similar to the rocker spring units shown in U.S. Pat. No. 2,772,723 and U.S. Pat. No. 2,871,916, being attached to the inner face of the adjacent rocker block rather than to the arm stretcher.

In this embodiment, a platform rocker is provided with conventional rocker blocks 210 at each side of the chair and fixed to the chair arms 212 so as to be rockably supported upon a rocker base 214.

Rocker spring units, generally indicated by 220 extend between the rocker blocks and rocker base 214.

Rocker spring units 220 include a pair of coil springs 222 which extend between and are fixed to upper and lower spring retainers 224 and 226 respectively, the latter being identical to the lower spring retainer 26 of the FIGS. 1 – 4 embodiment.

Upper spring retainer 224 is attached as by screws 228 to the inner face of the adjacent rocker block 210, the screws extending inwardly through provided openings in an offset flange 230 on the upper spring retainer.

The uppermost convolutions of the springs are retained in upwardly struck portions 232 on upper spring retainer 224 and the lowermost convolutions are retained in upwardly struck portions 234 on lower spring retainer 226.

The rocker spring units extend upwardly through provided openings 236 in rocker base 214.

The lower wall 238 of lower spring retainer 226 is provided with stops 240 in the form of axially-aligned horizontally-disposed extensions on its longitudinal axis at each end thereof which extend outwardly therefrom so as to underlie the lower face of rocker base 214.

The length and width of opening 236 is such as to permit the free passage of the entire rocker spring unit therethrough with the exception of lower wall 238 of lower spring retainer 226 which is of greater length than that of opening 236, with the stops 240 extending past the end walls of and bridging said opening.

As with the FIGS. 1 – 4 construction, rocker spring unit 220 is secured relative to rocker base 214 without the use of bolts or screws or other fastening means, the stops precluding unwanted displacement of lower spring retainer 226 during rocking.

Figure 10:
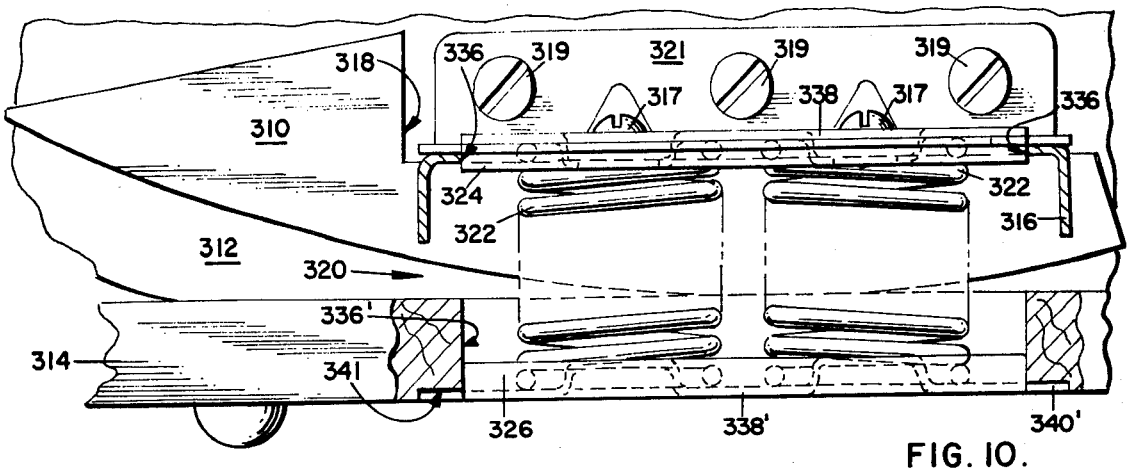
FIG. 10 is a fragmentary view, similar to FIG. 1, of a fourth embodiment of the spring unit of the invention.
Figure 11:
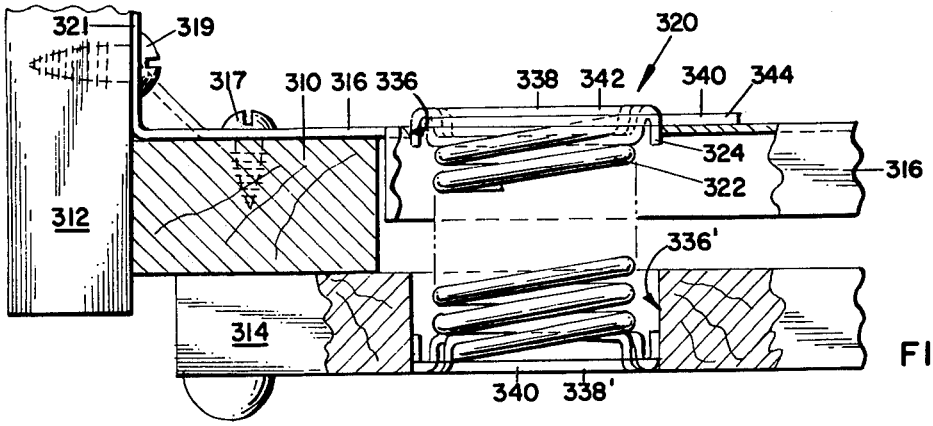
FIG. 11 is a fragmentary view, in end elevation, partly in section, of the structure shown in FIG. 10.
Figure 12:
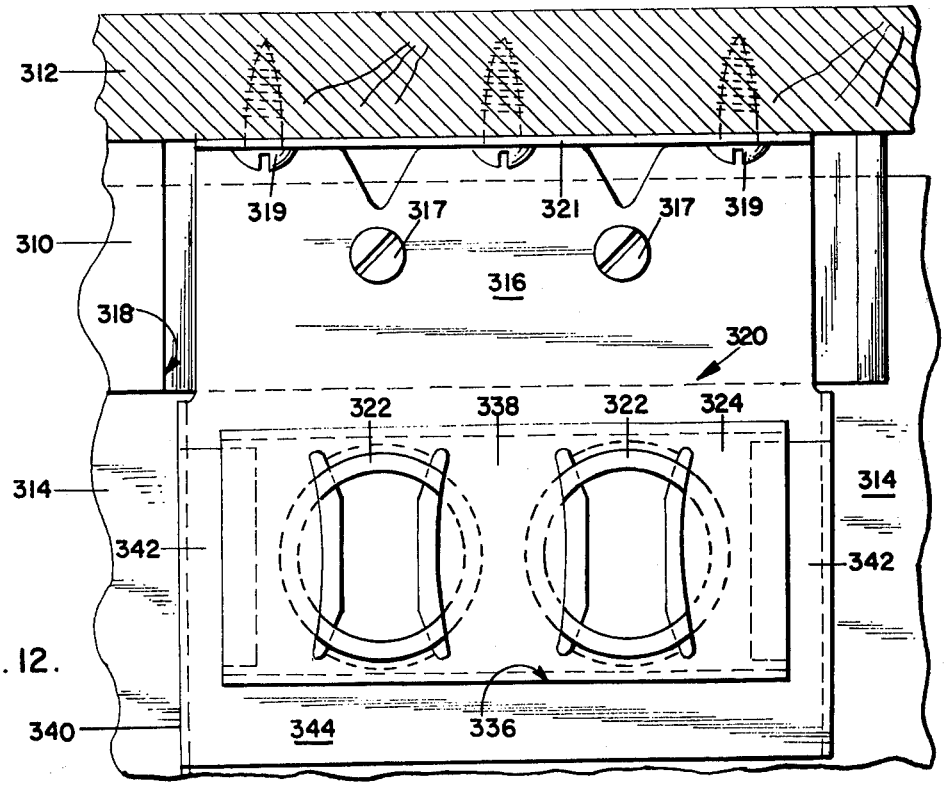
FIG. 12 is a fragmentary view, in top plan, of the structure shown in FIG. 10.

In the embodiment of FIGS. 10 – 12, a channel shaped metal arm stretcher replaces the wooden arm stretcher of the FIGS. 1 and 5 embodiments and the spring unit is attached to both the rocker base and arm stretcher without the use of screws or bolts or like fastening means.

In FIGS. 10 – 12 a platform rocker is provided with conventional rocker blocks 310 at each side of the chair and fixed to the chair arms 312 so as to be rockably supported upon a rocker base 314.

An arm stretcher 316, which extends between and interconnects the chair arms, is seated in a cut-out 318 provided in the upper surface of each rocker block, the arm stretcher preferably being formed from metal and being attached as by screws 317 to the rocker block 310 and as by screws 319 to the inner face of the adjacent chair arm 312, the screws 319 extending inwardly through provided openings in an offset flange 321 on each end of the arm stretcher.

Rocker spring units embodying a fourth form of the invention extend between arm stretcher 316 and rocker base 314.

Only one rocker spring unit, generally indicated by 320, has been shown in the drawings, although it will be understood that two rocker spring units will be employed, one at each side of the chair.

Rocker spring units 320 include a pair of coil springs 322 which extend between and are fixed to upper and lower spring retainers 324 and 326 respectively.

Upper spring retainer 324 is identical to the lower retainer 126 of FIGS. 5 – 7 while lower spring retainer 326 is identical to lower retainer 26 of FIGS. 1 – 4.

Upper spring retainer 324 includes an upper wall 338 which is of approximately the same dimensions as those of an opening 336 in stretcher 316.

A U-shaped stop plate 340 similar to that shown in FIG. 7 and comprising a pair of arms 342 interconnected at one end by a web portion 344 is slidably associated with upper spring retainer 324, with the arms extending outwardly from the ends of the spring retainer and the web portion extending outwardly from one side edge thereof so as to extend beyond the ends and one side wall of opening 336 in arm stretcher 316 to bridge the opening and to bear on the upper face of the arm stretcher.

The rocker spring units extend downwardly through the openings 336 in arm stretcher 316 and through provided openings 336′ in rocker base 314.

A lower wall 338′ of lower spring retainer 326 is provided with vertical stops in the form of axially-aligned horizontally-disposed extensions 340′ on its longitudinal axis at each end thereof which extend outwardly therefrom so as either to underlie the lower face of rocker base 314 or to be receivable in notches 341 in the rocker base lower face.

The length and width of opening 336′ is such as to permit the free passage of the entire rocker spring unit therethrough with the exception of lower wall 338′ of lower spring retainer 326 which is of greater length than that of opening 336′, with the stops 340′ extending past the end walls of said opening so as to bridge the opening.

By this novel arrangement, the rocker spring unit is secured relative to rocker base 314 and arm stretcher 316 without the use of bolts or screws or like fastening means, the stops 340 and 340′ effectively precluding any unwanted displacement of the rocker spring units as the chair is rocked.

Herein the rocker spring unit is inserted through opening 336′ in the rocker base and through opening 336 in arm stretcher 316 and then stop plate 340 is attached to secure the unit to the arm stretcher and rocker base, without the use of screws or bolts or like fastening means.

Figure 13:
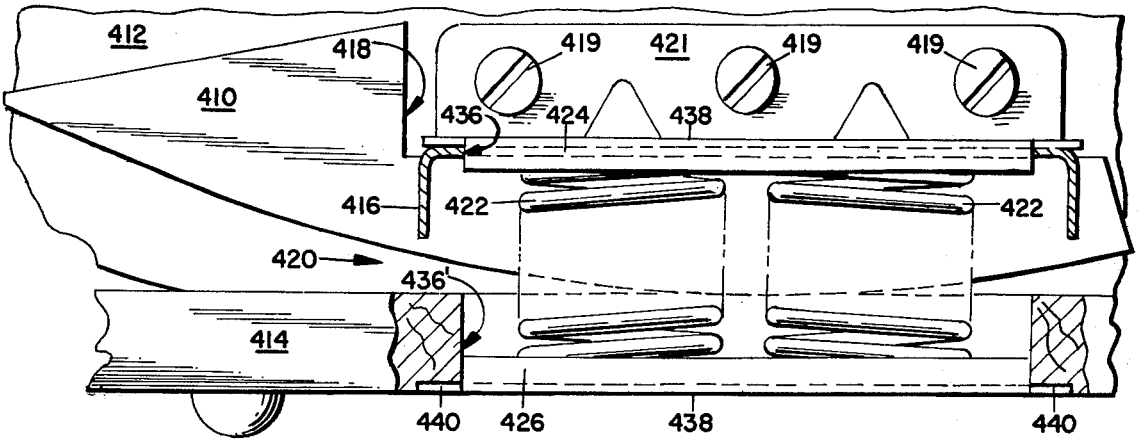
FIG. 13 is a fragmentary view, similar to FIG. 1, of a fifth embodiment of the spring unit of the invention.
Figure 14:
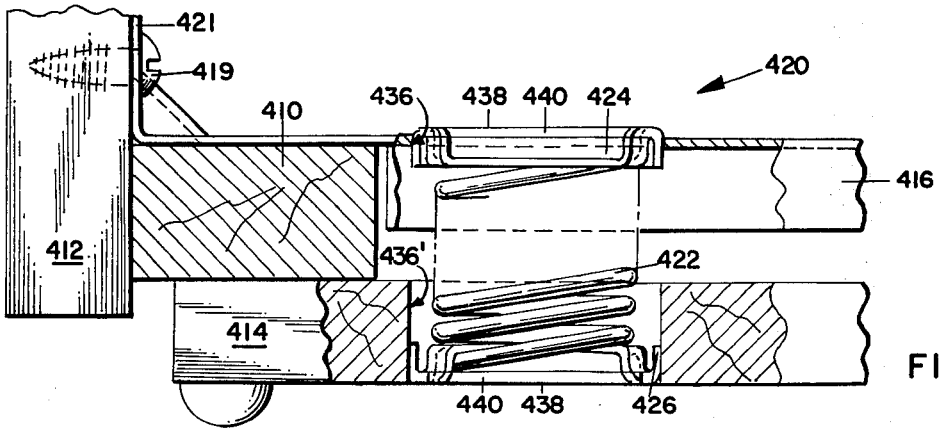
FIG. 14 is a fragmentary view, in end elevation, partly in section, of the structure shown in FIG. 13.
Figure 15:
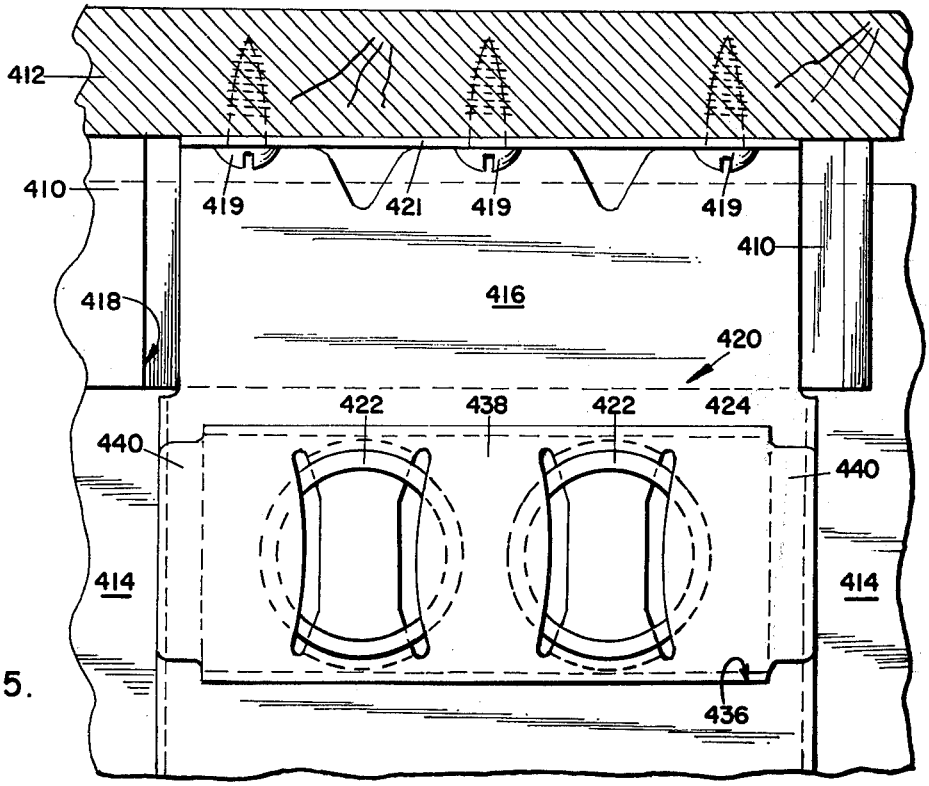
FIG. 15 is a fragmentary view, in top plan, of the structure shown in FIG. 13.

The embodiment of FIGS. 13 – 15 is virtually identical to that of the FIGS. 10 – 12 embodiment with the exception that the upper and lower spring retainers of the rocker spring units are both formed with integral stops or extensions.

Herein, a platform rocker is provided with conventional rocker blocks 410 at each side of the chair and fixed to the chair arms 412 so as to be rockably supported upon a rocker base 414.

An arm stretcher 416, which extends between and interconnects the chair arms, is seated in a cut-out 418 provided in the upper surface of each rocker block, the arm stretcher preferably being formed from metal and being attached as by screws 419 to the inner face of the adjacent chair arm 412, the screws extending inwardly through provided openings in an offset flange 421 on each end of the arm stretcher.

Rocker spring units, generally indicated by 420, extend through an opening 436 in arm stretcher 416 and through an opening 436′ in rocker base 414.

Rocker spring units 420 include a pair of coil springs 422 which extend between and are fixed to upper and lower spring retainers 424 and 426 respectively, both of which are identical to the lower spring retainer 26 of the FIGS. 1 – 4 embodiment, with each including an outer wall 438, which is provided with vertical stops in the form of axially-aligned horizontally-extending extensions 440 on its longitudinal axis at each end thereof which extend outwardly therefrom, with the extensions on upper spring retainer 424 overlying the upper face of stretcher 416 and the extensions on lower spring retainer 426 underlying the lower face of rocker base 414.

In this embodiment, the spring unit is preferably inserted upwardly through the openings in the rocker base and arm stretcher. However, the upper spring retainer must be twisted to permit its passage through the openings. Once it has been positioned in overlying relation to the arm stretcher it is released whereupon the stops 440 of upper retainer 424 extend past the end walls of opening 436 in stretcher 416 and the stops 440 of lower retainer 426 extend past the end walls of opening 436' in rocker base 414, to secure the spring unit against unwanted displacement during rocking.

Figure 16:
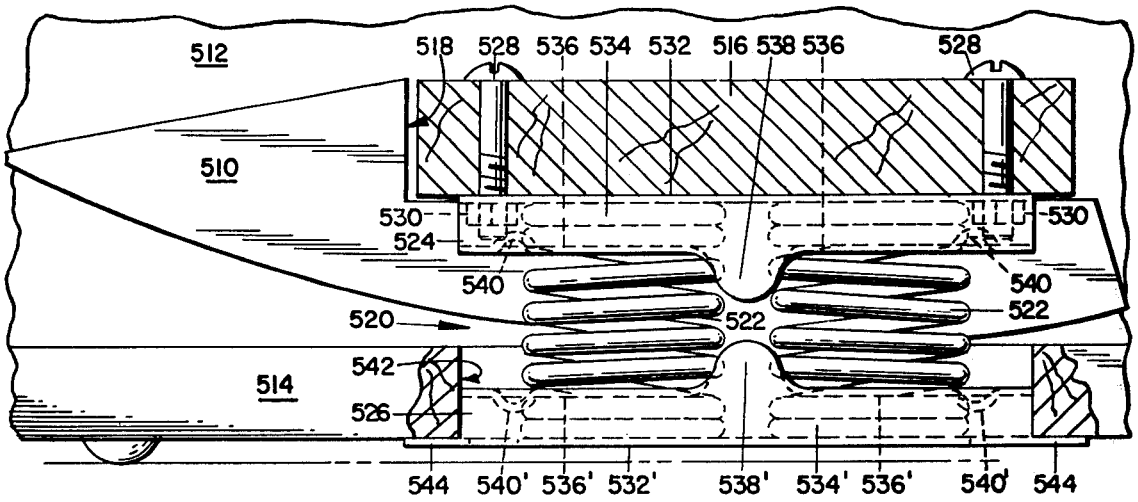
FIG. 16 is a fragmentary view, similar to FIG. 1, of a sixth embodiment of the spring unit of the invention.
Figure 17:
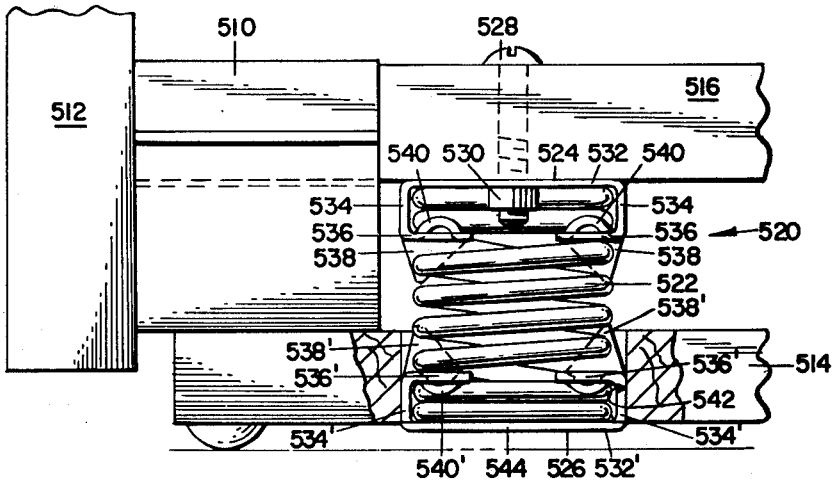
FIG. 17 is a fragmentary view, in end elevation, partly in section, of the structure shown in FIG. 16.
Figure 18:
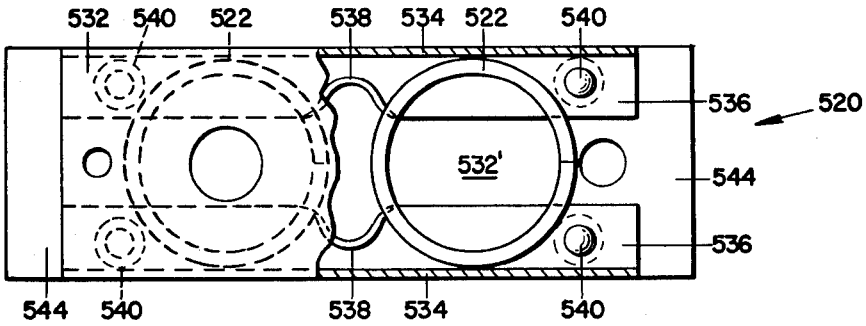
FIG. 18 is a view, in top plan, of the FIG. 16 spring unit, with parts broken away for clarity.

In the FIGS. 16 – 18 embodiment, a platform rocker is provided with conventional rocker blocks 510 at each side of the chair and fixed to the chair arms 512 so as to be rockably supported upon a rocker base 514.

An arm stretcher 516, which extends between and interconnects the chair arms 512, is seated in a cut-out 518 provided in the upper surface of each rocker block.

Rocker spring units embodying another modified form of the invention extend between arm stretcher 516 and rocker base 514.

Only one rocker spring unit, generally indicated by 520, has been shown in the drawings, although it will be understood that two rocker spring units will be employed, one at each side of the chair.

Rocker spring units 520 include a pair of coil springs 522 which extend between and are fixed to upper and lower spring retainers 524 and 526 respectively.

Upper spring retainer 524 is attached to the lower surface of arm stretcher 516 by means of bolts 528 which extend downwardly through aligned openings in the arm stretcher and the upper spring retainer and have nuts 530 threaded thereon.

The upper spring retainer includes an upper horizontal wall 532 through which the bolts 528 extend and a pair of depending side walls 534 which are bent inwardly at their lower ends to provide inwardly-extending flanges 536 disposed in spaced parallelism to upper wall 532 and so positioned as to be disposed under the upper pair of convolutions of springs 522.

Each side wall is provided with centrally located depending formed stops 538 against which the springs abut.

A portion of each flange 536 is dimpled as at 540 adjacent the ends of the retainer to preclude shifting of the springs.

The lower spring retainer 526 is substantially similar to upper spring retainer 524 and includes a lower horizontal wall 532' and a pair of upright side walls 534' which are bent inwardly at their upper ends to provide inwardly-extending flanges 536' disposed in spaced parallelism to lower wall 532' and so positioned as to be disposed over the lower pair of convolutions of springs 522.

Each side wall is provided with centrally located upright formed stops 538' against which the springs abut.

A portion of each flange 536' is dimpled as at 540' adjacent the ends of the retainer to preclude shifting of the springs.

Herein, the springs 522 are pushed inwardly from each end of the retainer until they abut the stops 538 and 538' with the two upper and lower convolutions of the springs being trapped by the flanges 536 and 536'. Once the springs abut the stops 538 and 538' the dimples 540 and 540' are struck in the flanges to lock the springs in place.

The rocker spring units extend upwardly through provided openings 542 in rocker base 514.

Lower wall 532' of lower spring retainer 526 is provided with vertical stops in the form of axially-aligned horizontally-disposed extensions 544 on its longitudinal axis at each end thereof which extend outwardly therefrom so as to underlie the lower face of rocker base 514.

The length and width of opening 542 is such as to permit the free passage of the entire rocker spring unit therethrough with the exception of lower wall 532' of lower spring retainer 526 which is of greater length than that of opening 542, with the stops 544 extending past the end walls of said opening so as to bridge the opening.

By this novel arrangement, the rocker spring unit is secured relative to rocker base 514 without the use of bolts or screws or like fastening means, the stops 544 effectively precluding any unwanted displacement of lower spring retainer 526 as the chair is rocked.

I claim:

1. A rocker spring unit for a platform rocker chair of the type wherein a rocking component has rocker blocks associated with a rocker base comprising, an upper spring retainer and a lower spring retainer, spring means extending between and fixed to the upper and lower spring retainers, the rocker spring unit operably connected between the rocker base and rocking component, at least one of said rocker base or said rocking component having an opening through which the rocker spring unit passes, and wherein the operable connection includes stops on at least one of the upper and lower spring retainers for precluding displacement of the rocker spring unit during rocking, the stops being non-pivotal relative to the spring retainers and comprising oppositely extending horizontally-disposed extensions on the spring retainers extending outwardly beyond the walls of said opening to prevent further movement of said at least one retainer through said opening.

2. A rocker spring unit according to claim 1, wherein the stops comprise a plate slidably associated with the spring retainer and having axially-aligned horizontally-disposed extensions extending outwardly therefrom beyond the walls of an opening in the rocker base or rocking component through which the rocker spring unit passes.

3. A rocker spring unit according to claim 1, wherein the upper spring retainer is fixed to the rocker blocks of the rocking component.

4. A rocker spring unit according to claim 1, wherein the chair rocking component includes an arm stretcher extending between the rocker blocks, the upper spring retainer being fixed thereto.

5. A rocker spring unit according to claim 1, wherein the chair rocking component includes an arm stretcher extending between the chair arms, the upper spring retainer being fixed thereto.

* * * * *